United States Patent [19]

Warner

[11] 4,388,864

[45] Jun. 21, 1983

[54] LITHOGRAPHIC DAMPENING SYSTEM

[75] Inventor: Gordon R. Warner, Goleta, Calif.

[73] Assignee: Warner "Autolitho" Corporation, Goleta, Calif.

[21] Appl. No.: 231,998

[22] Filed: Feb. 6, 1981

Related U.S. Application Data

[63] Continuation-in-part of Ser. No. 968,384, Dec. 11, 1978, abandoned.

[51] Int. Cl.[3] ..... B41L 25/12; B41L 25/14

[52] U.S. Cl. ..... 101/148; 101/451; 366/152

[58] Field of Search ..... 101/147, 148, 451, 465; 366/152

[56] References Cited

U.S. PATENT DOCUMENTS

| | | | |
|---|---|---|---|
| 1,675,695 | 7/1928 | Claybourn | 101/426 X |
| 1,977,646 | 10/1934 | Rowell | 101/465 |
| 2,728,690 | 12/1955 | Saeman | 101/350 |
| 3,191,528 | 6/1965 | Jorgensen | 101/350 |
| 3,252,411 | 5/1966 | Black | 101/124 |
| 3,495,808 | 2/1970 | Kline | 366/152 |
| 3,557,817 | 1/1971 | Royse | 101/148 |
| 3,687,694 | 8/1972 | Van Dusen | 101/451 |
| 3,696,746 | 10/1972 | Harper | 101/451 |
| 3,714,891 | 2/1973 | Van Dusen et al. | 101/451 |
| 3,758,330 | 9/1973 | Richman | 101/465 |
| 3,794,301 | 2/1974 | Simmonds | 366/152 |
| 3,843,099 | 10/1974 | Duncan | 366/152 |
| 3,844,994 | 10/1974 | Vijayendran | 101/451 |
| 3,947,356 | 3/1976 | Werhli | 101/147 |
| 4,000,692 | 6/1977 | Wirz | 101/148 |
| 4,052,937 | 10/1977 | Lawson | 101/147 |
| 4,088,074 | 5/1978 | Dahlgren | 101/148 |
| 4,146,474 | 3/1979 | Kagatani | 101/147 |
| 4,151,796 | 5/1979 | Uhrig | 101/148 |
| 4,176,605 | 12/1979 | Yoshida | 101/451 |
| 4,209,258 | 6/1980 | Daker | 366/152 |

FOREIGN PATENT DOCUMENTS

| | | | |
|---|---|---|---|
| 1239708 | 5/1967 | Fed. Rep. of Germany | 101/147 |

*Primary Examiner*—Clyde I. Coughenour

*Attorney, Agent, or Firm*—Harry W. Brelsford; Roland H. Shubert

[57] ABSTRACT

Water and oil base ink are delivered to lithographic plates as a single liquid, a mixture of water and ink, wherein the water is in the form of fine droplets dispersed in the ink. Preferably also, lithographic concentrate is added to the mixture as part of the water content. During a printing run the mixture is automatically resupplied to the printing machine by a level sensor that controls the amount of ink and water and by a pH sensor that controls the concentrate percentage. The proportion of ink and water is controlled by a moisture sensor. The thickness of the film of mixture delivered to the lithographic plate is controlled by a density sensor. A viscosity sensor controls the agitation of the mixture. As few as three rollers are required to deliver the ink-water-concentrate dispersion from a fountain to a lithographic plate.

6 Claims, 2 Drawing Figures

LITHOGRAPHIC DAMPENING SYSTEM

CROSS-REFERENCE TO RELATED APPLICATIONS

This application is a continuation-in-part of U.S. patent application Ser. No. 968,384 filed Dec. 11, 1978 now abandoned.

BACKGROUND OF THE INVENTION

This invention relates generally to planographic printing and has particular relevance to lithography and similar printing techniques which depend upon delineation of the printed subject matter by means of hydrophilic and oleophilic areas on a printing surface or plate; ink being repelled by the water-wetted areas and being retained by the oil-wetted areas.

More specifically, this invention relates to a process for applying a dispersed mixture of ink, water and lithographic concentrate as a single liquid to lithographic plates and continuously forming that dispersed mixture in proper ratio of components for application to a lithographic plate.

DISCUSSION OF THE PRIOR ART

Conventional printing machines for newspapers and other high-production printing presses generally use the lithographic process wherein metal plates are treated to have water-retaining or water-loving areas and grease-retaining or oil-loving areas to define the printed subject matter. This process is based upon use of inks that have an oil base and the ink is repelled by the water-dampened areas and absorbed by the oil-retaining areas. Such lithographic inks employ pigments that are not soluble in water so as to avoid any tinting.

In this prior art, the plates are wrapped around cylinders referred to as plate cylinders. Water is applied at one axially parallel line on the surface of the rotating cylinders, and downstream from the water, ink is applied along another longitudinal line. The best quality printing is obtained not by printing directly from the plate cylinder, but by transferring the ink from the plate cylinder to a blanket cylinder coated with a rubber-like surface. A third cylinder called an impression cylinder presses a strip of paper against the surface of the blanket roller to print the paper. Thus, three principal cylinders are used, the plate cylinder, the blanket cylinder, and the impression cylinder.

In addition to these three principal cylinders, a cluster of cylinders or rollers is used to transport the water from a trough called a fountain to the plate cylinder, and an even more elaborate set of rollers is used to transport the ink from the ink trough or fountain to the surface of the plate cylinder. Frequently, as many as six rollers or cylinders are used in the water cluster, and as many as twenty or twenty-five rollers and cylinders are used in the ink cluster.

It is also known to use emulsion inks in lithographic printing processes wherein the ink comprises a storage and handling-stable emulsion of water, usually containing concentrate, and ink. The emulsion is supplied to the lithographic plate through a single set or cluster of rollers or cylinders. Such an inking system requires means for breaking the ink emulsion prior to its contact with the lithographic plate. Refrigerated rollers coupled with shearing rollers are typically used to demulsify the ink. An example of a lithographic printing process using an emulsion ink is set out in U.S. Pat. No. 4,176,605.

SUMMARY OF THE INVENTION

Ink and water may be transferred from a single fountain and applied to a lithographic plate through a single set or cluster of rollers by use of a dispersion of water and ink. The dispersion is unstable and immediately separates into ink and water components when allowed to be quiescent. Ink, water, and concentrate are continuously supplied to an agitated fountain in controlled amounts so as to maintain the proper ratios of the components in response to sensed variables including viscosity, liquid level, pH and water proportion.

As few as three cylinders are needed in the roller cluster to transfer the ink-water dispersion from the fountain and apply it to the plate. This results in a mixture applicator of small size that may be applied to any cylinder in conventional printing presses thus enabling the blanket and/or impression cylinders of a printing press to be used as a second plate cylinder to thereby double the capacity of existing machines. Even though considerably simpler than typical ink and water applicators of the prior art, there results an image quality superior to that obtained by use of the conventional inking and dampening systems.

Hence, it is an object of this invention to provide an improved method for applying an ink-water mixture to a lithographic plate.

Other objects, advantages and features of the invention will be apparent from the description of the invention and preferred embodiments thereof.

DISCUSSION AND DESCRIPTION OF THE INVENTION

The process of this invention includes use of a single fountain wherein ink, water and concentrate are continuously agitated to maintain the mixture in a dispersed state of small water droplets within the oil-base ink. A single set of transfer rollers is used to deliver the ink-water dispersion to a lithographic plate carried on a plate cylinder. As few as three rollers or cylinders are adequate to transfer the dispersion from the fountain to the plate cylinder.

Although the dispersion used in this process would seem to be quite similar to emulsion inks, this is not the case. The ink-water dispersion used comprises small water droplets suspended in oil by agitation and will separate immediately upon cessation of agitation into its components. Emulsion inks on the other hand comprise a stabilized mixture of ink and water and of course are applied to the plate cylinder through a single set of transfer rollers. The use of emulsion inks produces two mutually contradictory requirements. First, the emulsion must be sufficiently stable so as to not separate into its components during transport and storage, including its residence time in a fountain of the printing press. Secondly, the emulsion must be sufficiently non-stable so as to break down into ink and water prior to contact with the lithographic plate. If the emulsion itself were applied to the lithographic plate, it will smear over the entire plate surface resulting in either no image at all or one of unacceptably low quality. Consequently, provision must be made in the roller train transferring the emulsion from the fountain to the plate for emulsion breaking.

One conventional way of breaking the emulsion is to provide one or more refrigerated rollers as most ink-water emulsions are not stable at relatively low temperatures. Because emulsion breaking requires a temperature of about 50 degrees F. or lower, a substantial amount of refrigeration capacity must be provided to maintain the chilled rollers at such temperature levels. In addition to the power consumed by the refrigeration requirements, the press speed is limited to the heat transfer capability of the chilled rollers. Thus, press speeds may be limited by ambient temperature conditions; being lower at high temperatures than at low.

There is another substantial disadvantage accruing from the use of emulsion inks. Because the inks are preformulated, the water-ink ratios are preset and cannot be changed unless, of course, one were to substitute a different ink. The relative amount of ink and water consumed during successive printing runs, or for that matter, in the course of a single run, is not fixed but can vary widely. The relative amounts of ink and water required to produce a high quality lithographic impression are affected by a number of factors including the relative humidity of the air, the moisture content of the paper web, and the ratio of image area to blank or unprinted area of the lithographic plate. Use of an emulsion ink precludes adjustment of the ink-water ratios to adjust for the differing requirements of a printing run. As may be appreciated simply by scanning the pages of a newspaper, the ratio of printed to non-printed areas or dark areas versus light areas varies considerably column to column.

The process of this invention also substantially reduces paper waste as compared to most conventional systems. At the beginning of a printing run, the plate cylinder and the cylinder trains making up the conventional inking and dampening systems are dry. A considerable number of impressions must be made on the paper web passing through the press before the inking and dampening systems come into equilibrium and a clean, clear image is obtained. The paper carrying images of unacceptable quality is, of course, wasted. Because of the simplified roller train needed in this process and because this single train serves to transfer both ink and water, equilibrium is attained much more rapidly. As fewer low quality impressions are obtained, paper wastage is concomitantly reduced.

DESCRIPTION OF PREFERRED EMBODIMENTS

Figure 1:
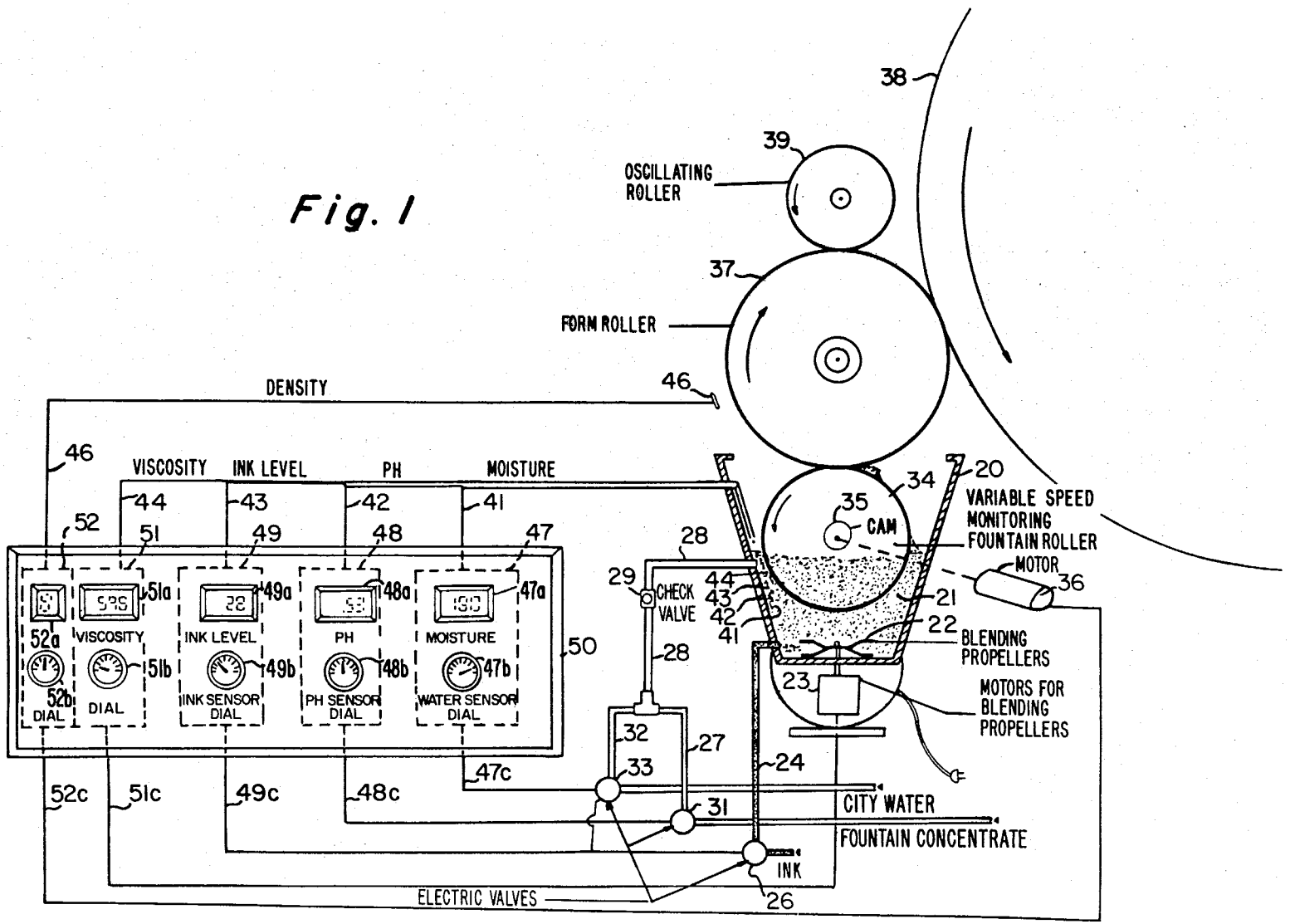
FIG. 1 is a diagrammatic view of the inking apparatus used in carrying out the process of this invention.

Referring to FIG. 1, a trough 20, referred to in the industry as a fountain, holds a mixture 21 of ink, water, and fountain concentrate, and this mixture is finely divided or dispersed by a series of agitation propellers 22 driven by motors 23. The ink is supplied to the trough 20 by a pipe 24 controlled by an electric valve 26 connected to a source of ink under pressure (not shown). The fountain concentrate is supplied to the trough 20 by a pipe 27 connected to a pipe 28 having a check valve 29, and flow of concentrate is controlled by an electric valve 31 connected to a source of concentrate under pressure (not shown). Water is supplied by a pipe 32 also connected to the pipe 28, and flow is controlled by an electric valve 33 connected to a source of water such as a domestic or municipal water supply.

Partially immersed in the ink-water mixture 21 in the trough 20 is a fountain roller 34 driven by a variable speed motor 36. This roller 34 is in rolling contact with a form roller 37 which rotates at a uniform velocity. The viscosity of the ink-water mixture on the surface of the fountain roller 34 causes the two rollers 34 and 37 to not actually engage each other, approximately by the distance of the thickness of the ink-water film transferred to the form roller 37. A cam 35 is provided to adjust the pressure between the fountain roller 34 and the form roller 37, and this is a manual adjustment for the particular ink-water mixture and, once set, is not changed during printing. The form roller 37 is in rolling contact with a plate cylinder 38, on which is disposed a lithographic plate made of metal whose surface is treated to form hydrophilic areas and oleophilic areas that define the printed subject matter. The form roller transfers the ink-water mixture in finely dispersed form so that discrete particles of water adhere to the hydrophilic areas and discrete particles of oil base ink adhere to the oleophilic areas. When paper is rolled against this surface of plate cylinder 38, the ink is transferred to the paper and the subject matter is printed.

I presently prefer to have a third roller to complete the transfer of the ink-water mixture, and this is an oscillating roller 39 in contact with form roller 37. This roller 39 oscillates back and forth on its fixed axis of rotation to spread evenly the film of ink-water mixture on the surface of form roller 37. As mentioned previously, these three rollers 34, 37, and 39 apply both ink and water to the plate cylinder in contrast to the conventional clusters of several dozens of rollers for the same purpose. My assembly of three rollers occupies such a small space in conventional printing machines or presses that they can be readily inserted into existing presses not only on plate cylinders, but also on blanket and impression cylinders that are converted to plate cylinders.

Control of the Mixture

The mixture of ink, water, and concentrate is being continuously depleted during a printing run and must be continuously resupplied. I have devised an automatic mechanism to effect this resupply and presently prefer to control it by a microprocessor. To this extent my controller may be termed a mini-computer. However, prior automatic controls may also function effectively, and I do not limit myself to computer mechanisms.

Referring to FIG. 1, I dispose four sensors in the ink-water and concentrate mixture 21, a water concentration sensor 41, a pH sensor 42, a mixture level (ink level) sensor 43, and a viscosity sensor 44. I dispose a fifth sensor 46 opposite the form roller 34, and this sensor preferably measures photoelectrically the density of the film of mixture 21 on that roller. While this is shown as measured on roller 37, it could also be measured on roller 34 or by stroboscopic lights on cylinder 38 or the printed paper itself.

Each sensor 41–46 has its output conducted by wires of the same number to controllers 47, 48, 49, 51, and 52, respectively, preferably disposed in a panel 50 and each preferably having a readout, preferably digital. The moisture controller 47 has a readout **47*a* and a dial 47*b* for setting the controller 47 for the predetermined percentage of water in the mixture. Determining the percentage of water automatically determines the percentage of ink, inasmuch as the precentage of concentrate (pH) is about one percent, sometimes a little more and generally less than one percent. Leading from the bottom of controller 47 is a wire 47***c* connected to the water valve 33, which opens wider or closes down to admit more or less water.

The pH controller 48 has a readout 48*a* and a setting dial 48*b* to fix the pH. These concentrates (pipe 27) are proprietary products usually compounded to work with a proprietary lithographic ink, or in the case of color with a family of inks. Some concentrates are acidic and others are alkaline, the acids having a pH of 5 or 6 and the alkalines about 9 or 10. The exact percentage of concentrate depends upon the mineral content of the water supply and varies from city to city. Some printers try to avoid the concentration determination by using distilled water or deionized water. However, the dial setting is placed at the manufacturer's recommended pH, and the controller 48 maintains it by opening up or closing down valve 31 by means of a wire 48*c*. As mentioned previously, the concentrate percentage is small, usually around one percent or less.

The ink level (mixture level) in the trough 20 is controlled, because the amount of immersion of fountain roller 34 affects the thickness of the film of mixture on form roller 37. I prefer to keep it below the rotation axis of the fountain roller. The level sensor 43 delivers its output to the controller 49 having readout 49*a* and a setting dial 49*b* which controls the level. This is accomplished by a wire 49*c* leading from controller 49 to both the water valve 33 and ink valve 26 so that the flow of both may be increased or decreased in unison.

The viscosity sensor 44 delivers its output to the controller 51 having readout 51*a* and dial setting 51*b* and having a wire 51*c* leading to the variable speed mixture motor 23. Actuation of the motor 23 causes agitation resulting in more mixing of the water and ink into finer particles, to change the viscosity. Viscosity is also changed as the agitators heat up the mixture. Agitation may be effected in any desired manner. The viscosity determines the amount of ink-water-concentrate mixture that is picked up by the fountain roller 34. The amount of mixing of ink and water for satisfactory results may vary between wide limits. The mixing breaks up the water into droplets, each of which is surrounded by a film of oily ink. Generally, any mixture having eighty-five droplets or more per linear inch is satisfactory, but 200 or more is preferable.

The density sensor indicates several things, the color of the ink, the thickness of the film, the reflectivity of the surface of form roller 37, etc. For any given ink being used it forms an effective control for the film thickness on the form roller 37. The output of sensor 46 is delivered to controller 52 having a readout 52*a* and a dial setting 52*b*. Leading from the controller 52 is a wire 52*c* connected to the variable speed motor 36. This motor drives the fountain roller 34 faster to obtain a thicker film of mixture and slower to obtain a thinner film.

I presently prefer the controllers 47, 48, 49, 51, and 52 to include microprocessors which are solid state electronic circuits commonly used in computer control circuits. I prefer these over more conventional automatic controls because of the memory aspect that regulates the control electronically for a preselected setting of the dials 47*b*, 48*b*, 49*b*, 51*b*, and 52*b*. The controllers do not necessarily supply the actuating current, but may deliver only control current to speed controls at the motors and variable controls at the valves.

Figure 2:
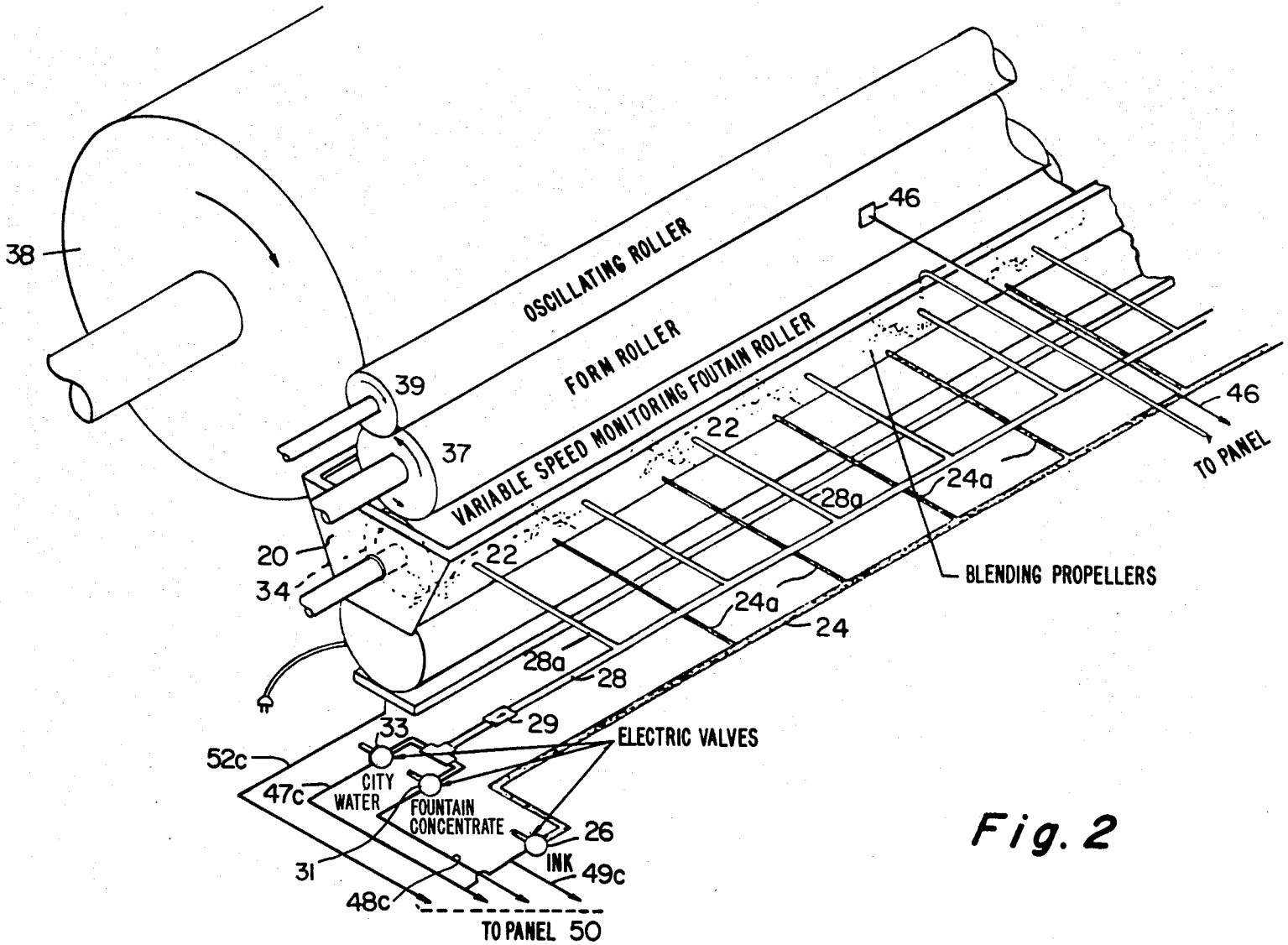
FIG. 2 is a three-dimensional view of the mechanical parts of FIG. 1, but deleting the control circuits.

Referring now to FIG. 2, the apparatus of FIG. 1 is shown in three dimensions. There it will be noted that the ink pipe 24 has branches 24*a* leading to each part of the trough 20 that has agitation propellers 22. Similarly, the water concentrate pipe 28 has a corresponding number of branch pipes 28*a*.

Operation

Referring to FIG. 1, to start an inking run, the panel 50 is energized and ink, water, and concentrate flow into the trough 20 through pipes 24, 27, 32, 28 until the desired level is reached. The level sensor 43 then actuates the valves 26 and 33 to shut off flow, and the pH sensor 42 controls the concentrate flow valve 33. At the same time the mixing propellers 22 are actuated and remain continuously in motion at greater or lesser speeds under the control of the viscosity sensor 44. The printing press is then actuated, causing plate cylinder 38 to rotate as well as fountain roller 34, form roller 37, and oscillating roller 39, and the printing process is in full operation.

The fountain roller 34 picks up mixture 21 from trough 20 and the excess is squeezed out at the contact line with form roller 37. The density sensor 46 delivers its output to the thickness controller 52, which delivers a signal by wire 52*c* to the motor 36 to speed up roller 34 if the film is too thin and slow up roller 34 if it is too thick.

The percentage of water (and inversely the percentage of ink) in the mixture is continuously monitored by sensor 41, and the water flow through valve 33 is automatically increased or decreased to keep the percentage at setting made by dila 47*b*. The percentage of water and ink in my process is approximately the same as that consumed by the same or similar press using conventional separate water and ink supply mechanisms. A typical mixture is fifty-four percent ink, forty-five percent water, and one percent concentrate.

The amount or percentage of concentrate is regulated automatically by pH sensor 42 and controller 48, which opens or closes valve 31 to give more or less concentrate.

The viscosity sensor 44 controls the propellers 22 by delivering its output to controller 51, which in turn delivers a current over wire 51*c* to motors 23 to control their speed.

The desired control setting for each controller is dialed into it by dials 47*b*, 48*b*, 49*b*, 51*b*, and 52*b*. If microprocessors are used, this setting is stored in its memory. The readouts 47*a*, 48*a*, 49*a*, 51*a*, and 52*a* give a visual check of the correct functioning of the system for the information of the operator.

Thus, there is provided a process for continuously supplying both water and ink components to a fountain, maintaining a dispersion of ink and water in the fountain and continuously applying the dispersed liquid to a lithographic plate. Advantages obtained through practice of this process include smaller press power requirements, less paper wastage and greater control over impression quality.

It will be appreciated by those skilled in the art that the ink, water, and concentrate can be continuously mixed in any suitable vessel and circulated through the printing press fountain to supply a continuously updated mixture. Also, the continuous mixing can take place in a separate vessel which continuously supplies the mixture to the fountain as it is consumed.

I claim:

1. The method of continuously applying ink and water-concentrate to lithographic plates during a continuous printing run of a printing press having an ink fountain, comprising:

(a) continuously mixing separately supplied streams of ink, water and concentrate in a single fountain to form a finely dispersed mixture;

(b) continuously applying the mixture from the fountain to a lithographic plate through a single roller train;

(c) continuously flowing said separate streams of ink, water and concentrate to the mixture to replace that consumed by the lithographic plate;

(d) continuously sensing the mixture in the fountain for indications of mixture ratios, and (e) continuously utilizing the sensed responses for continuously regulating the flow of each of said ink, water and concentrate streams to the mixture in said fountain to maintain a predetermined ratio of ink, water, and concentrate and to replenish that consumed during the printing run, thereby automatically maintaining a constant mix for roller train despite the changing rates of consumption of the various components during the print run and at different locations along the length of the ink train.

2. The method of claim 1 wherein the dispersed liquid is applied to the lithographic plate as a film and wherein the density of said film is controlled by photoelectric scanning of the surface of one of the rollers in said train.

3. The method of claim 2 wherein said train comprises three rollers.

4. The method of claim 1 wherein the continuous sensing includes sensing the pH of the dispersed liquid in said fountain and regulating the flow of concentrate to the fountain in response to the pH sensing so as to maintain a predetermined pH.

5. The method of claim 1 wherein the continuous sensing includes sensing the ink-water ratio in said fountain and regulating the flow of at least one of said ink or water in response to said sensing to thereby maintain a predetermined ink-water ratio.

6. The method of claim 1 including the additional steps of continuously monitoring the viscosity of the dispersed liquid in said fountain and adjusting the intensity of agitation of said liquid in response to said monitoring whereby a predetermined viscosity is obtained.

* * * * *